US012017741B2

(12) United States Patent
Lämmle

(10) Patent No.: US 12,017,741 B2
(45) Date of Patent: Jun. 25, 2024

(54) DEVICE AND METHOD FOR LAUNCHING AN UNDERWATER PROJECTILE FROM A WATERCRAFT

(71) Applicants: Atlas Elektronik GmbH, Bremen (DE); thyssenkrupp AG, Essen (DE)

(72) Inventor: Knud Lämmle, Hamburg (DE)

(73) Assignees: Atlas Elektronik GmbH, Bremen (DE); thyssenkrupp AG, Essen (DE)

( * ) Notice: Subject to any disclaimer, the term of this patent is extended or adjusted under 35 U.S.C. 154(b) by 397 days.

(21) Appl. No.: 17/293,143

(22) PCT Filed: Dec. 4, 2019

(86) PCT No.: PCT/EP2019/083661
§ 371 (c)(1),
(2) Date: May 12, 2021

(87) PCT Pub. No.: WO2020/126502
PCT Pub. Date: Jun. 25, 2020

(65) Prior Publication Data

US 2022/0009607 A1 Jan. 13, 2022

(30) Foreign Application Priority Data

Dec. 20, 2018 (DE) ..... 10 2018 222 490.0

(51) Int. Cl.
*B63G 8/32* (2006.01)
*F41F 3/04* (2006.01)
(Continued)

(52) U.S. Cl.
CPC ..... *B63G 8/32* (2013.01); *F41F 3/0413* (2013.01); *F41F 3/07* (2013.01); *F41F 3/10* (2013.01)

(58) Field of Classification Search
CPC ... B63G 8/32; F41F 3/0413; F41F 3/07; F41F 3/10
See application file for complete search history.

(56) References Cited

U.S. PATENT DOCUMENTS 3,721,155 A * 3/1973 Stauff ..... F41F 3/052 89/1.807
4,173,919 A 11/1979 Piesik
(Continued)

FOREIGN PATENT DOCUMENTS

DE 690 03 190 T 1/1994
DE 102010048222 A1 * 4/2012 ..... B63G 8/32
(Continued)

OTHER PUBLICATIONS

Machine Translation of EP 0978676 A1. Ponsot. Feb. 2000. (Year: 2000).*
(Continued)

*Primary Examiner* — Gabriel J. Klein
(74) *Attorney, Agent, or Firm* — thyssenkrupp North America, LLC

(57) ABSTRACT

A launching device and associated methods can be utilized to launch an underwater running body from a platform such as a watercraft. The launching device may include a ramp, which extends along a longitudinal ramp axis, and a propellant deflection unit. The ramp may enclose an underwater running body with a propulsion unit underwater. The launching device may activate the propulsion unit, which then emits a propellant. The propellant deflection unit deflects the emitted propellant into an outlet direction. This outlet direction of the propellant may be directed perpendicularly or obliquely away from the platform.

21 Claims, 4 Drawing Sheets

(51) Int. Cl.
*F41F 3/07* (2006.01)
*F41F 3/10* (2006.01)

(56) References Cited

U.S. PATENT DOCUMENTS 4,185,538 A * 1/1980 Barakauskas ..... F41F 3/07 89/1.81
4,373,420 A 2/1983 Piesik
4,934,214 A 6/1990 Otte
4,934,241 A * 6/1990 Piesik ..... F41F 3/0413 89/1.816
5,194,688 A 3/1993 Piesik
5,542,333 A * 8/1996 Hagelberg ..... F41F 3/07 220/849
5,613,460 A * 3/1997 Stallard, III ..... B63G 8/30 114/321
5,837,919 A 11/1998 Yagla
6,079,310 A 6/2000 Yagla
6,427,574 B1 * 8/2002 Callahan ..... F41F 3/07 89/1.817
6,526,860 B2 * 3/2003 Facciano ..... F41F 3/042 89/1.819
2005/0108917 A1 * 5/2005 Kunstmann ..... F41F 3/0413 42/135

FOREIGN PATENT DOCUMENTS

EP 0978676 A1 * 2/2000
EP 2 003 417 A 12/2008
EP 2 107 331 A 10/2009
GB 2124741 A * 2/1984 ..... F41F 3/0413
WO WO-2012017229 A1 * 2/2012 ..... B63G 8/32

OTHER PUBLICATIONS

English Translation of International Search Report issued in PCT/EP2019/083661, dated Feb. 20, 2020.

* cited by examiner

DEVICE AND METHOD FOR LAUNCHING AN UNDERWATER PROJECTILE FROM A WATERCRAFT

The invention relates to a launching device for launching an underwater running body from a platform, in particular from a watercraft, and to a method using such a launching device.

CROSS REFERENCE TO RELATED APPLICATIONS

This application is a U.S. National Stage Entry of International Patent Application Serial Number PCT/EP2019/083661, filed Dec. 4, 2019, which claims priority to German Patent Application No. DE 10 2018 222 490.0, filed Dec. 20, 2018, the entire contents of both of which are incorporated herein by reference.

FIELD

The present disclosure generally relates to methods and devices for launching underwater projectiles from watercraft.

BACKGROUND

It is known to launch large rockets from a submarine vertically upward. For example, the rocket is fired out of the ramp of the sub marine by means of compressed air while the submarine is under water and near the surface of the water. Once the fired rocket has left the water, a propulsion unit of the rocket is ignited.

Vertical firing ramps for rockets are known from underwater vehicles and also from surface ships. In some applications, the rocket is brought into the ramp in a canister and is fired vertically or obliquely upward out of this canister, the canister staying in the firing ramp.

Thus, a need exists for a simpler launching device that allows launching of the underwater running body.

DETAILED DESCRIPTION

Figure 1:
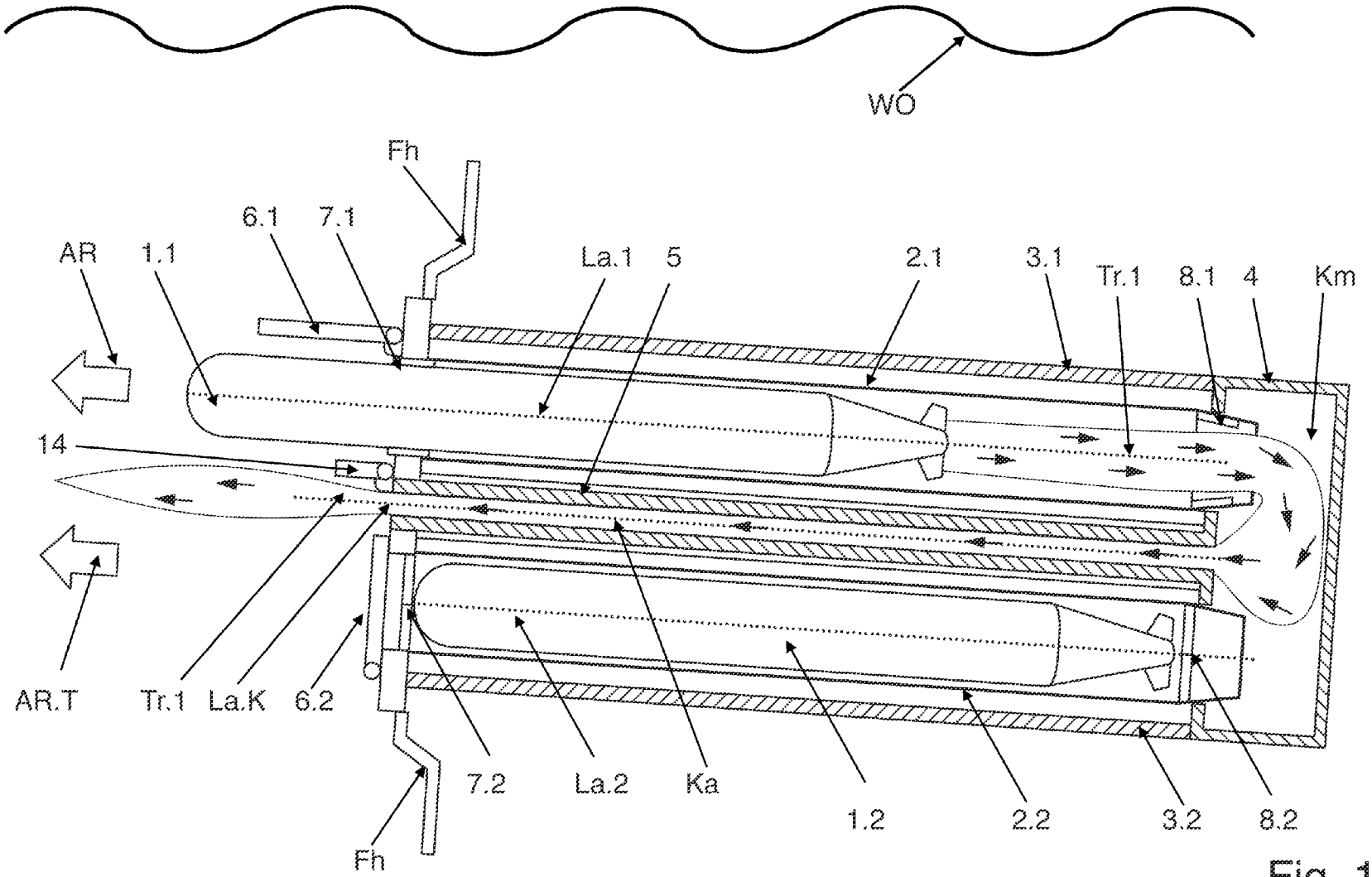
FIG. 1 is a side view of an example launching device with two ramps for two underwater rockets, with a rocket propulsion unit of one underwater rocket having just been ignited and with the other underwater rocket being still locked.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to launching devices for launching an underwater running body from a platform, in particular from a watercraft, and to methods for launching such an underwater running body.

The launching device according to the invention is able to launch an underwater running body under water from a watercraft or from some other platform.

The underwater running body to be launched comprises a propulsion unit. This propulsion unit can be activated and, after activation, emits the propellant The launching device according to the solution comprises
a ramp and
a propellant deflection unit.

The ramp extends along a longitudinal ramp axis and is able to enclose and hold the underwater running body under water. The launching device is able to activate the propulsion unit of the underwater running body, while the underwater running body is enclosed and held under water by the ramp. Once the underwater running body is launched, the ramp guides the launched underwater running body on the first part of its path of movement, dependent on the orientation of the longitudinal ramp axis.

The propellant deflection unit guides emitted propellant in an outlet direction. This outlet direction of the propellant is directed vertically or obliquely away from the platform on which the launching device is mounted and from which the underwater running body is launched.

An underwater running body in the sense of the invention is an unmanned underwater vehicle which converts a fuel into propellant, for example burns it, emits the propellant produced and is moved through the water by the emission of the propellant. It is possible that the underwater running body has an additional drive means. The underwater running body may operate autonomously or for example be remote-controlled by wire.

According to the solution, the launching device is able to launch an underwater running body with a propulsion unit. An underwater running body with a propulsion unit, which emits a propellant, can in many cases achieve a greater acceleration and reach a target under water more quickly than an underwater running body that is driven exclusively by at least one propeller. This is important in some applications, for example if the underwater running body is intended to neutralize an attacking torpedo before it reaches the platform, for example a surface ship, or some other target.

The launching of the underwater running body with the aid of the launching device according to the solution does not depend on the water depth of the launching device at the moment of launching at all, or at least depends on it to a lesser extent than known launching devices.

The launching device according to the solution is able to receive and launch the underwater running body while the ramp of the launching device and the underwater running body are below the surface of the water. The target for the underwater running body may also be completely or at least partially below the surface of the water. It is possible to design the underwater running body for use exclusively under water. The movement of the underwater running body can in this case be controlled more easily than if the underwater running body were to fly through the air as well as travel through the water. In particular, it is prevented that the underwater running body changes its path of movement rapidly, and in a way that is difficult or impossible to control, which can happen if the underwater running body breaks through the surface of the water from the water or from the air.

The launching device according to the solution is able to activate the propulsion unit of the underwater running body while the underwater running body is still in the ramp and the ramp is enclosing and holding the underwater running body. The ramp guides the launched underwater running body on a first part of the path of movement, until the underwater running body has reached a certain speed, and consequently kinetic energy, and there is a reduced risk of water flows etc. making the underwater running body deviate from its path. These underwater flows may occur for example as a result of the forward movement through the water of a platform that is carrying the launching device according to the solution. The propulsion unit is filled with a propellant and emits propellant produced after activation. By the emission of the propellant, the underwater running body is pushed out of the ramp. Thanks to the propulsion unit, the underwater running body is fired out of the ramp without compressed air or a piston or some other firing mechanism being required in order to fire the underwater running body. Such a mechanism requires space and electrical and/or hydraulic and/or mechanical energy.

Both are generally only available to a limited extent on board a platform, in particular if the platform is an underwater vehicle. Furthermore, a firing mechanism often requires regular servicing and/or maintenance, and there is the risk of this firing mechanism failing. A pneumatic circuit for a pneumatically operated firing mechanism has the further disadvantage that gas bubbles can leave a leak and rise up to the surface of the water, which in many cases is undesired. The invention consequently leads to a launching device with a simpler mechanical construction and reduces the risk of gas bubbles already occurring before launching.

Because less space is required and no additional firing mechanism has to be installed, the launching device can be provided more easily on board an already existing platform. Often, the launching device together with the or each underwater running body can be accommodated in already existing torpedo tubes, arranged under water, of a surface vessel or underwater vehicle.

Often, an underwater running body is supplied in a canister. The canister together with the underwater running body is inserted into the ramp. When the propulsion unit is activated and emits propellant, the underwater running body leaves the canister, which stays in the ramp. It is possible, but not necessary thanks to the invention, that a firing mechanism opens or perforates the canister in order to fire the underwater running body.

When the propulsion unit has been activated, the underwater running body in the ramp emits propellant in a direction of emission, which is generally parallel to the longitudinal ramp axis and opposite to the direction in which the underwater running body leaves the ramp (action equals reaction). As a result, the underwater running body is displaced in a launching direction parallel to the longitudinal ramp axis and after that is fired out of the ramp. The launching direction of the underwater running body is generally directed away from the platform, and therefore the direction of emission of the propellant is directed toward the platform. In particular in the case of a watercraft as the platform, it is undesired that the emitted propellant gets inside the watercraft or excessively heats up the ramp or a hull of the watercraft. The propellant deflection unit prevents this undesired event.

Also, there must not be any danger to a member of the crew of the platform comprising the launching device with the ramp and to the platform itself if, because of a fault, the underwater running body does not leave the ramp after the propulsion unit has been activated, but for example is jammed in the ramp or is otherwise held fast, or if a flap of the ramp has not been opened. In this case, the underwater running body keeps emitting propellant in the ramp until the propellant of the propulsion unit is completely depleted. Therefore, a considerably greater amount of propellant is emitted in the ramp than in the case of a fault-free launch. Thanks to the propellant deflection unit, in spite of this fault, the emitted propellant moves away from the platform, specifically in the direction of emission that the propellant deflection unit establishes. This feature prevents the dangerous, and therefore undesired, event that the emitted propellant heats up the ramp to such an extent that propellant or a warhead of the underwater running body explodes or detonates or the heated ramp or a vehicle hull is damaged.

It is possible, but not necessary thanks to the propellant deflection unit, that the launching device has a mechanism that switches off the propulsion unit or deactivates a warhead if, because of a fault, the underwater running body does not leave the ramp after activation of the propulsion unit.

In one embodiment of the invention, the propellant deflection unit is designed and arranged in such a way that the following is brought about:

- the outlet direction of the propellant is parallel to the longitudinal ramp axis, and consequently parallel to the firing direction of the underwater running body;
- the propellant deflected by the propellant deflection unit leaves the propellant deflection unit at a distance from the longitudinal ramp axis, for example with a lateral or vertical offset.

In this design, the propellant is emitted in the same direction as the underwater running body is fired, but with a lateral offset and not from the ramp but from the propellant deflection unit. When the underwater running body is launched under water, an impulse is only exerted on the surrounding water in one direction, specifically on the one hand by the underwater running body and on the other hand by the emitted propellant. Consequently, vortices and/or gas bubbles do not occur at two locations in the water at a distance from one another, which can be detected and can provide information about the firing platform.

Furthermore, this design allows a particularly compact and space-saving type of construction. The entire launching device extends substantially along the longitudinal ramp axis and has only relatively small dimensions perpendicularly to the longitudinal ramp axis. This is important in particular whenever the launching device is mounted on board an underwater vehicle.

In an alternative design, the outlet direction of the propellant forms an acute angle with the longitudinal ramp axis. Preferably, an acute or obtuse angle occurs between the outlet direction and the firing direction of the underwater running body. The propellant deflection unit deflects the propellant by an obtuse angle. The angle of deflection is preferably greater than 60°, particularly preferably greater than 120°.

In the case of the design with the obtuse angle of deflection, the distance between the launched underwater running body and the propellant that has left the propellant deflection unit increases during the movement of the underwater running body. As a result, an interaction between the propellant that has left the propellant deflection unit and the underwater running body is avoided with greater certainty. This interaction is undesired in some situations, for example because the control of the movement of the underwater running body may be made more difficult or an active or passive sonar system of the underwater running body may provide falsified results.

In one design, the launching device comprises in addition to the first ramp a second ramp, which extends along a second longitudinal ramp axis and is at a distance from the first longitudinal ramp axis. The two longitudinal ramp axes may be arranged parallel to one another or form an angle. The second ramp is able to enclose, hold and guide a second underwater running body under water.

Thanks to the second ramp, the launching device is able to launch two underwater running bodys at the same time or one after the other without interim loading into a ramp being required.

It is possible that the launching device comprises a further propellant deflection unit. Each ramp is assigned a propellant deflection unit of its own. In a preferred design, on the other hand, this propellant deflection unit is assigned both to the first ramp and to the second ramp. The launching device is designed and arranged in such a way that the following is brought about:

- a propellant that is emitted from the first underwater running body in the first ramp is directed to the assigned propellant deflection unit;
- a propellant that is emitted from the second underwater running body in the second ramp is directed into the same assigned propellant deflection unit.

In this design, therefore, the same propellant deflection unit is used for at least two different ramps. This design saves space in comparison with a design in which each ramp is assigned a propellant deflection unit of its own.

It is possible that a first group with at least two ramps is assigned a first propellant deflection unit and a second group with at least one further ramp is assigned a second propellant deflection unit.

Preferably, the launching device comprises a locking device which is assigned to the first ramp. It is possible that the second ramp is assigned an identical further locking device. The or each locking device can be transferred into a locking state and into a release state, to be precise independently of each other locking device.

The assigned locking device in the locking state prevents the locked underwater running body in the ramp from moving in relation to the ramp, in particular becoming canted or slipping out of the ramp. The locking device in the release state allows the underwater running body to leave the ramp.

As long as the locking device is in the locking state, in a preferred design the launching device not only prevents or blocks a movement of the underwater running body but also an activation of the propulsion unit. As a result, the propulsion unit can only be activated when the locking device has been transferred into the release state.

In the locking state, the locking device prevents the underwater running body from performing an undesired movement in relation to the ramp before the propulsion unit has been activated. Such an undesired movement could damage the underwater running body and/or the ramp or lead to the underwater running body not being able to leave the ramp. According to the preferred design, the propulsion unit can only be activated, and the underwater running body can only leave the ramp, when the locking device is in the release state. Thanks to this design, the undesired event that the propulsion unit of the underwater running body is activated although the locking device is still in the locking state is prevented. This undesired event can lead to the underwater running body with an activated propulsion unit being held fast in the ramp, for example because emitted propellant prevents the locking device from being transferred into the release state.

In a development of this design, the launching device comprises a position sensor. This position sensor is able to positively detect the event that the locking device is in the release state. "Positively detect" means that the position sensor generates a signal when it has detected the event. The launching device is able to activate the propulsion unit once the position sensor has detected that the locking device is in the release state. Consequently, the propulsion unit is activated as a reaction to the event that the locking device is in the release state.

This design with the position sensor allows a legal requirement to be met, specifically that a propulsion unit may only be activated when a specific safety-relevant event has been physically detected. According to this design, the event that the position sensor detects that the locking device is in the release state, and has generated a corresponding signal, is used as the safety-relevant event. This design therefore shows a way of meeting the legal requirement for the activation of a propulsion unit.

Preferably, the position sensor sends a corresponding signal when it has discovered the release state. The propulsion unit can only be activated when the release signal is present. As a result, whenever the position sensor or a control unit of the launching device has failed or the signal transmission has been interrupted, a safe state, specifically that the propulsion unit is not activated, is ensured.

In one design, water can penetrate into the first ramp and/or into the second ramp, and this is desired. Preferably, the ramp flap closes the ramp with respect to surrounding water whenever the ramp flap is in a closed state. In an opened state, the ramp flap allows water to penetrate into the ramp. The launching device is able to open the ramp flap and thereby allow water to flow into the ramp. The launching device opens the ramp flap before the launching device activates the propulsion unit of the underwater running body. Consequently, the underwater running body in the ramp is surrounded by water when its propulsion unit is ignited. This makes it easier to control the path of movement of the underwater running body compared with a design in which the launched underwater running body suddenly encounters water.

According to experience, the launching device launches the underwater running body under water. Depending on the design of the launching device and the current operating situation, the outlet opening of the propellant deflection unit may be above or below the surface of the water. The emitted and deflected propellant may therefore be emitted above or below the surface of the water.

In one design, a deflection unit flap separates the propellant deflection unit from the surrounding fluid, in the case of emission of propellant under the surface of the water from the surrounding water, as long as the deflection unit flap is closed. In one design, an actuating element is able to open this deflection unit flap. In a preferred design, on the other hand, emitted and deflected propellant is able to open the deflection unit flap or else make it burst. This preferred design saves the need for an actuating element for the deflection unit flap.

In one design, the deflected propellant is only able to open the deflection unit flap if the pressure that the propellant exerts on the flap exceeds a predetermined limit. This limit can be set such that, in the event of a fault-free launch of the underwater running body, the flap remains closed and the pressure of the propellant additionally contributes to the recoil to fire the underwater running body. Only whenever the underwater running body does not leave the ramp because of a fault does the pressure of the emitted propellant open the flap.

The deflection unit flap in the closed state prevents surrounding fluid, in particular water, from being able to penetrate into the propellant deflection unit. Furthermore, whenever the platform is a watercraft, it is made possible that the deflection unit flap in the closed state contributes to an aerodynamic form of the watercraft. This reduces the risk of vortices of water being able to occur at an outlet opening of the propellant deflection unit.

If the emitted propellant is able to open the deflection unit flap, it is not necessary to open the deflection unit flap with the aid of an actuating element. Such an actuating element may be defective. Furthermore, in some applications it may take a lot of time to open the deflection unit flap with the aid of an actuating element. Opening with the aid of the propellant works quickly and without an actuating element.

In one application, the launching device according to the solution is mounted on board a watercraft. Preferably, the propellant deflection unit is mounted on board this watercraft in such a way that the following is brought about in a standard floating position of the watercraft: the entire path of movement, or at least the last section of the path of movement, of propellant that is directed into the propellant deflection unit and is moved through the propellant deflection unit is horizontal or ascending.

This design prevents the undesired event that gases remain in the propulsion deflection unit and only escape gradually during the travel of the watercraft. The watercraft would then leave behind it a trail of bubbles, which is often undesired, in particular for an underwater vehicle. Thanks to the design, rather, all gases leave in a single surge.

In one design, the launching device comprises a ramp actuating element. This ramp actuating element is able to pivot the ramp. In particular, the firing direction in which the underwater running body is fired out of the ramp can be changed. In one design, a pivoting of the ramp brings about the effect that the direction of emission in which the propellant is emitted from the propellant deflection unit is also changed.

The ramp actuating element is able to pivot the ramp, and consequently change the orientation of the longitudinal ramp axis, in relation to the platform. This allows the underwater running body to be launched in a desired direction of a number of possible directions. In the case of a watercraft as the platform, it is made possible that the ramp arranged under water is in a hydrodynamically favorable position in relation to the direction of travel of the watercraft before the underwater running body in the ramp is launched. Therefore, during the travel of the watercraft, the ramp causes relatively little water resistance. When the underwater running body is to be launched, the ramp actuating element pivots the ramp in relation to the vehicle hull into a desired position for launching.

The launching device according to the solution is a component part of a platform, in particular a watercraft, or can be mounted at least for a time on board a platform. In particular, thanks to the propellant deflection unit, it is often possible with little effort to retrofit a launching device according to the solution on board a platform or to supplement an existing launching device and thereby increase the operational reliability.

In one design, this watercraft comprises a weapon tube, for example a torpedo tube or a tube to fire mines or containers or underwater flotation aids. The entire launching device, or at least the ramp with the underwater running body and the optional locking device, is arranged in this weapon tube. It is possible that an adapter is fitted inside the weapon tube in order to bridge the distance between the larger inside diameter of the weapon tube and the smaller outside diameter of the ramp. It is even possible that two ramps of a launching device according to the solution are fitted inside the same weapon tube with the aid of an adapter. It is also possible to mount the launching device on an outer hull of the watercraft, so that the launching device is permanently surrounded by water and can be quickly made ready for launching an underwater running body.

The platform with the launching device may be a manned or unmanned surface vessel or underwater vehicle. This watercraft may have a drive of its own or be designed without a drive of its own. The platform may also be arranged stationarily on the water, for example on board a drilling platform or a buoy, or on land, and be installed there on a coast, for example to protect a harbor from attacks.

In the exemplary embodiment, the invention is applied in a launching device that is arranged on board an underwater vehicle, for example on board a manned submarine. The underwater vehicle has a vehicle hull Fh, for example a pressure hull or an outer hull. The launching device according to the solution is recessed flush in this vehicle hull Fh. Preferably, the launching device according to the solution is arranged completely outside the pressure hull, that is to say between the pressure hull and the outer hull, and when traveling submersed is exposed to the pressure of the surrounding water.

The invention can be applied equally well on board a surface vessel. In this application, the launching device is mounted on a region of the vehicle hull Fh of the surface vessel that remains permanently under the surface of the water during use. The underwater rocket stays under water the entire time it is traveling.

The launching device is able to launch at least one underwater rocket, in the exemplary embodiment a number of underwater rockets, under the surface of the water WO. An underwater rocket is understood as meaning a running body that is designed for use under water and has a rocket propulsion unit, that is to say a drive, which can be activated and, after activation, converts a fuel into a propellant, for example burns it, emits the propellant produced and thereby moves the running body in the opposite direction to the direction of emission of the propellant. In the exemplary embodiment, the underwater rocket stays under the surface of the water WO during the entire use and can withstand the water pressure to a predetermined maximum water depth. The underwater rocket may have a cruising propulsion unit and in addition a launching propulsion unit, which is only used for launching the underwater rocket, or a single propulsion unit for the entire time it is traveling. Hereinafter, the term "rocket propulsion unit" is used for that propulsion unit that brings about the launching of the underwater rocket from the ramp. Generally, an underwater rocket accelerates faster in the water than a torpedo, which is driven by at least one propeller.

Each underwater rocket also comprises a sonar system, which operates actively and/or passively, and a warhead with an explosive charge and is designed for locating another underwater running body by means of the sonar system, traveling to this other underwater running body and destroying it by igniting the explosive charge before the underwater running body reaches the watercraft with the launching device or another watercraft.

In FIG. 1, the launching device of an embodiment according to the solution is shown in a side view. The launching device comprises two ramps 3.1, 3.2 arranged one above the other, which have in each case the form of a cylindrical tube and extend in each case along a longitudinal ramp axis La.1 and La.2, respectively. The two parallel longitudinal axes La.1, La.2 of the two ramps 3.1, 3.2 lie in the plane of the drawing of FIG. 1. It is possible that further ramps of the launching device are arranged in front of or behind the ramps 3.1, 3.2. The direction of travel of the watercraft is perpendicular or oblique to the plane of the drawing of FIG. 1.

Each ramp 3.1, 3.2 is able in each case to receive a canister 2.1, 2.2 with an underwater rocket 1.1, 1.2. It is possible that an adapter is arranged inside a ramp 3.1, 3.2, in order that the same ramp 3.1, 3.2 is able to receive objects with different diameters one after the other. It is possible that an adapter is arranged inside a canister 2.1, 2.2, in order that a number of identical canisters 2.1, 2.2 for underwater rockets with different diameters can be used.

In one design, each ramp 3.1, 3.2 has in each case a muzzle flap 6.1, 6.2, which is opened before the launch of the underwater rocket 1.1, 1.2. At the latest when launching an underwater rocket 1.1, 1.2, the ramp 3.1, 3.2 is filled with water, so that there is no difference in pressure between the ramp 3.1, 3.2 and the surrounding water. The hull of the underwater rocket 1.1, 1.2 is able to withstand the surrounding water pressure. Instead of a muzzle flap 6.1, 6.2, a membrane that is perforated by the head of the underwater rocket 1.1, 1.2 when it is launched may also be provided on the outer end of a ramp 3.1, 3.2.

In one design, the ramps 3.1, 3.2 are movably fastened on the outer hull of the submarine. Before the underwater rockets 1.1, 1.2 are launched, the ramps 3.1, 3.2 are in a hydrodynamically favorable position, in which they cause as little water resistance as possible. Before an underwater rocket 1.1, 1.2 is launched, a ramp actuating element that is not shown pivots the ramps 3.1, 3.2 into a desired direction toward the target. It is also possible that the ramps 3.1, 3.2 are fixedly mounted on the outer hull, for example perpendicularly or obliquely in relation to the direction of travel. In another design, each ramp 3.1, 3.2 is in each case recessed in a torpedo tube of the submarine.

Each underwater rocket 1.1, 1.2 comprises a rocket propulsion unit and a number of stabilizing fins. The rocket propulsion unit is able to emit a propellant, which in the case of use under water moves the underwater rocket 1.1, 1.2 through the water. The stabilizing fins stabilize the movement of the underwater rocket 1.1, 1.2 through the water.

An underwater rocket 1.1, 1.2 is transported to the watercraft in each case in a round-cylindrical canister 2.1, 2.2. The canister 2.1, 2.2 with the underwater rocket 1.1, 1.2 is fitted into a ramp 3.1, 3.2 and remains ready for use in this ramp 3.1, 3.2 while the watercraft with the launching device according to the solution carries out a predetermined task. Each canister 2.1, 2.2 has in each case a front membrane 7.1, 7.2 and a rear membrane 8.1, 8.2. The terms "front" and "rear" relate to the direction of travel of the underwater rocket 1.1, 1.2 out of the canister 2.1, 2.2. The canister 2.1, 2.2 surrounds the underwater rocket 1.1, 1.2 in a watertight and airtight manner. The space in the canister 2.1, 2.2 around the underwater rocket 1.1, 1.2 is filled with a fluid, preferably an inert fluid. A closure plug 13 at the rear of the rocket propulsion unit of the underwater rocket 1.1 prevents fluid from penetrating into the interior of the propulsion unit before the propulsion unit is activated. The canister 2.1, 2.2 need not necessarily be able to withstand the pressure of the surrounding water or the pressure of the emitted propellant Tr.1. Rather, before the underwater rocket 1.1, 1.2 is launched, the ramp 3.1, 3.2 and/or the hull of the underwater rocket 1.1, 1.2, depending on the embodiment, absorbs this water pressure.

It is possible that recessed in the interior of the canister 2.1, 2.2 is a drainage channel, which extends parallel to the longitudinal ramp axis La.1, La.2 and guides emitted propellant, exhaust gases and fluid and makes it easier for them to flow out of the canister 2.1, 2.2. The outflow channel also makes it easier to fill the canister 2.1, 2.2 with a fluid.

Figure 2:
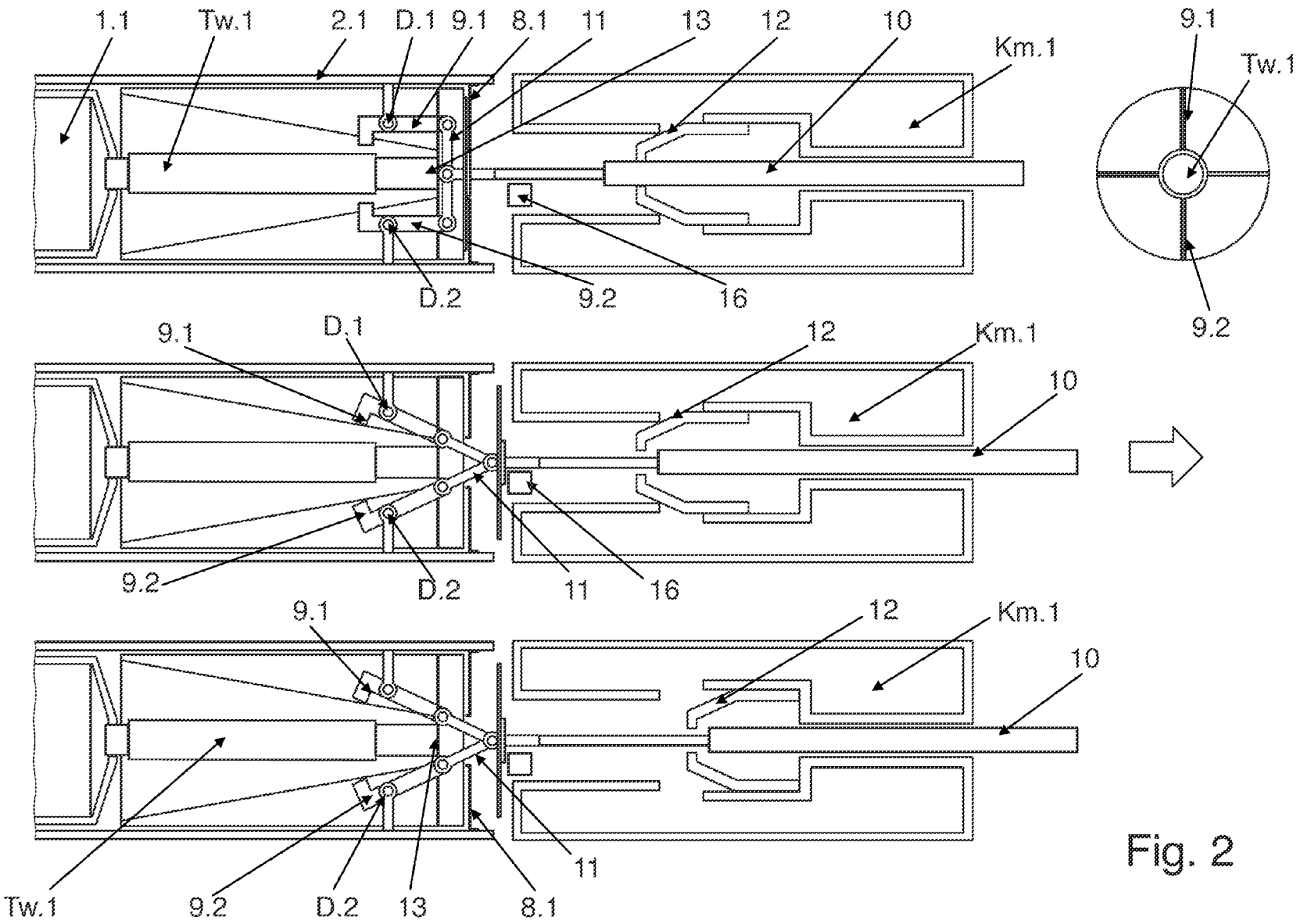
FIG. 2 is a schematic side view of three successive states of an example locking device for an underwater rocket.

FIG. 2 shows by way of example a locking device, which holds the underwater rocket 1.1 in the canister 2.1 and prevents the underwater rocket 1.1 from moving in relation to the canister 2.1 while the watercraft is traveling and before the launch, and therefore possibly becoming canted. Two claws 9.1 and 9.2 engage from two sides in corresponding clearances at the tail of the underwater rocket 1.1. The claw 9.1 is mounted rotatably about an axis of rotation D.1, the claw 9.2 about an axis of rotation D.2. The axes of rotation D.1 and D.2 are perpendicular to the plane of the drawing of FIG. 2 and preferably are supported on the wall of the canister 2.1. These two claws 9.1, 9.2 are connected by way of an articulated connection 11 to a pushrod 10. The pushrod 10 can be displaced linearly along the longitudinal ramp axis La.1. The pushrod 10 is surrounded by a chamber Km.1, which is filled with a fluid that is under positive pressure. A closing unit 12 closes this chamber Km.1. It is possible that three or four claws engage from three or four sides in corresponding clearances in the underwater rocket 1.1, which is indicated in the cross-sectional representation on the right in FIG. 2.

In order to release the locking of the underwater rocket 1.1 in the canister 2.1, the pushrod 10 is pulled to the rear, that is to say away from the canister 2.1 with the underwater rocket 1.1 (to the right in FIG. 2). As a result, the closing unit 12 is also pulled to the rear, and the fluid that is under positive pressure emerges from the chamber Km.1, moves the pushrod 10 rearwards and holds it in the pulled-back position. The conical shape of the closing unit 12 accentuates the linear movement of the pushrod 10 away from the canister 2.1. The linear movement of the pushrod 10 brings about the effect that the articulated connection 11 goes over from a T shape into a Y shape. The two points at which the connection 11 is connected to the two claws 9.1 and 9.2 are moved toward one another. This in turn brings about the effect that the two claws 9.1 and 9.2 are turned about the two axes of rotation D.1 and D.2—or all four claws about the respective axis of rotation—and release the underwater rocket 1.1 in the canister 2.1. The linear movement of the pushrod 10 away from the underwater rocket 1.1 also brings about the effect that the rear membrane 8.1 of the canister 2.1 is perforated.

In compliance with the requirements of STANAG 4368, the ignition of the propulsion unit Tw.1 of the underwater rocket 1.1 is blocked as long as the locking device with the claws 9.1, 9.2 holds the underwater rocket 1.1 in the canister 2.1. A position sensor 16, for example a contact switch, generates a signal when the connection 11 strikes against the position sensor 16 during the movement away from the canister 2.1. This event means that the locking device (claws 9.1, 9.2, pushrod 10, connection 11) is in the release position. As soon as the event that the claws 9.1, 9.2 are in a release position is positively detected, the blocking of the ignition of the propulsion unit Tw.1 is lifted, and the propulsion unit of the underwater rocket 1.1 can be ignited, and consequently activated. The canister 2.1 is electrically connected to a triggering device (not shown) outside the ramp 3.1, which ignites the propulsion unit Tw.1. The closure plug 13 on the rear of the propulsion unit Tw.1 of the underwater rocket 1.1 is discharged out of the canister 2.1 through the opened rear membrane 8.1.

In FIG. 1, a situation in which the propulsion unit Tw.1 of the first underwater rocket 1.1 has been ignited and is emitting the propellant Tr.1 is shown. The underwater rocket 1.1 leaves the canister 2.1 in a firing direction AR, and the first canister 2.1 stays in the ramp 3.1. The second underwater rocket 1.2 is still locked in the second canister 2.2.

The propellant Tr.1 emitted from the underwater rocket 1.1 and emitted exhaust gases penetrate the rear membrane 8.1 and arrive in a chamber Km, which is located behind the two ramps 3.1 and 3.2, cf. FIG. 1. If the launching device has a further pair of ramps arranged one above the other, a corresponding chamber is preferably likewise arranged behind these further ramps.

The chamber Km is surrounded by a wall 4, which can withstand the heat and the mechanical impulse of the emitted propellant Tr.1. In particular, the wall 4 contributes to stopping propellant Tr.1 from getting into the interior of the watercraft. Further propellant Tr.1 is emitted through the membrane 8.1, and the rear membrane 8.2 of the second canister 2.2 is closed and can likewise withstand the propellant Tr.1. Therefore, the emitted propellant Tr.1 can only escape from the chamber Km through a channel Ka. This channel Ka extends along a longitudinal axis La.K and is surrounded by a wall 5, which likewise can withstand the heat and mechanical impulse of the propellant Tr.1. The longitudinal axis La.K of the channel Ka is preferably not arranged horizontally, but slightly ascending, which is indicated in FIG. 1. Therefore, the wall 4 around the chamber K and the wall 5 around the channel Ka direct the emitted propellant Tr.1 to an outlet A, which is recessed flush in the vehicle hull Fh. This outlet A is closed by a flap 14 or membrane. The diverted propellant Tr.1 opens this flap 14 or membrane. An actuating element for the flap 14 is therefore not necessary. In one design, the outlet A is closed by a closure flap with a predetermined breaking point. The emission of the propellant Tr.1 from the channel Ka brings about the effect that this closure flap breaks at the predetermined breaking point, fragments are discharged and after that the outlet A is open.

In one design, the emitted propellant Tm.1 always opens the flap 14. In an alternative design, the emitted propellant Tm.1 only opens the flap 14 if the pressure that the propellant Tm.1 exerts on the flap 14 from the inside is above a predetermined limit. As long as the flap 14 is still closed, the pressure of the emitted propellant Tm.1 contributes to firing the underwater rocket 1.1. At the same time, the desired safety effect is ensured, in particular if the underwater rocket 1.1 does not leave the ramp 3.1.

The propellant Tr.1, together with the fluid from the canister 2.1, exhaust gases and evaporated water, is emitted to the outside through the opened outlet A in a direction of emission AR.T. The desired effect that the propellant Tr.1 is emitted to the outside occurs whenever the underwater rocket 1.1 is jammed in the canister 2.1 or in the ramp 3.1, and therefore does not leave the ramp 3.1. In this case, the entire propellant Tr.1 of the underwater rocket 1.1 is guided to the outside through the chamber Km, the channel KA and the outlet A without entering the interior of the watercraft.

Seen in the direction in which the propellant Tr.1 is pushed through the channel Ka, the channel Ka ascends slightly. Therefore, and because the propellant Tr.1 is lighter than water, the entire propellant Tr.1 that is emitted into the chamber Km and enters the channel Ka quickly leaves the channel Ka again. No emitted gas collects in the channel Ka. This prevents the watercraft from leaving a trace of bubbles behind it because propellant or exhaust gases gradually leave the channel Ka. This effect is undesired in particular whenever the watercraft is an underwater vehicle traveling submersed.

In the example of FIG. 1, the chamber Km with the wall 4 and the channel Ka with the wall 5 and the outlet A are assigned to two adjacent ramps 3.1 and 3.2 and belong to a propellant deflection unit. Consequently, in each case a deflection device for the propellant is assigned to two adjacent ramps. This design makes it possible to save space, because fewer chambers and channels than the launching device has ramps are required. Also possible is an alternative design in which each ramp is assigned a propellant deflection unit of its own. The design with a propellant deflection unit of its own saves the need for the rear membrane 8.1, 8.2 of a canister 2.1, 2.2 having to be able to withstand the emitted propellant of another underwater rocket.

In one design, the channel Ka extends parallel to the longitudinal axis La.1, La.2 of a ramp 3.1, 3.2. The propellant Tr.1 is emitted parallel to the travel of the underwater rocket 1.1 and with a lateral offset. The propellant deflection unit consequently deflects the propellant Tr.1 by 180°.

Figure 3:
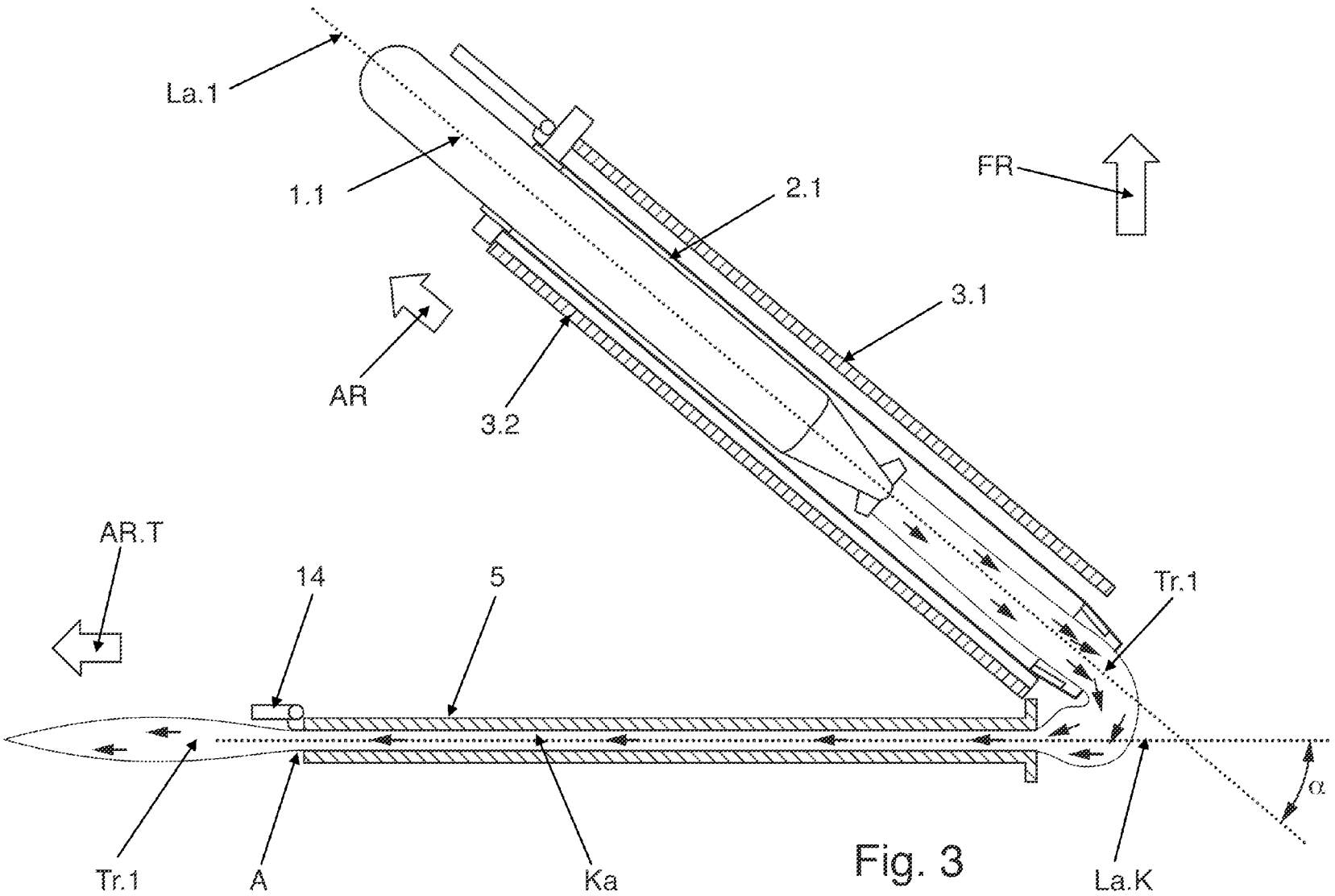
FIG. 3 is a plan view of another example launching device.
Figure 4:
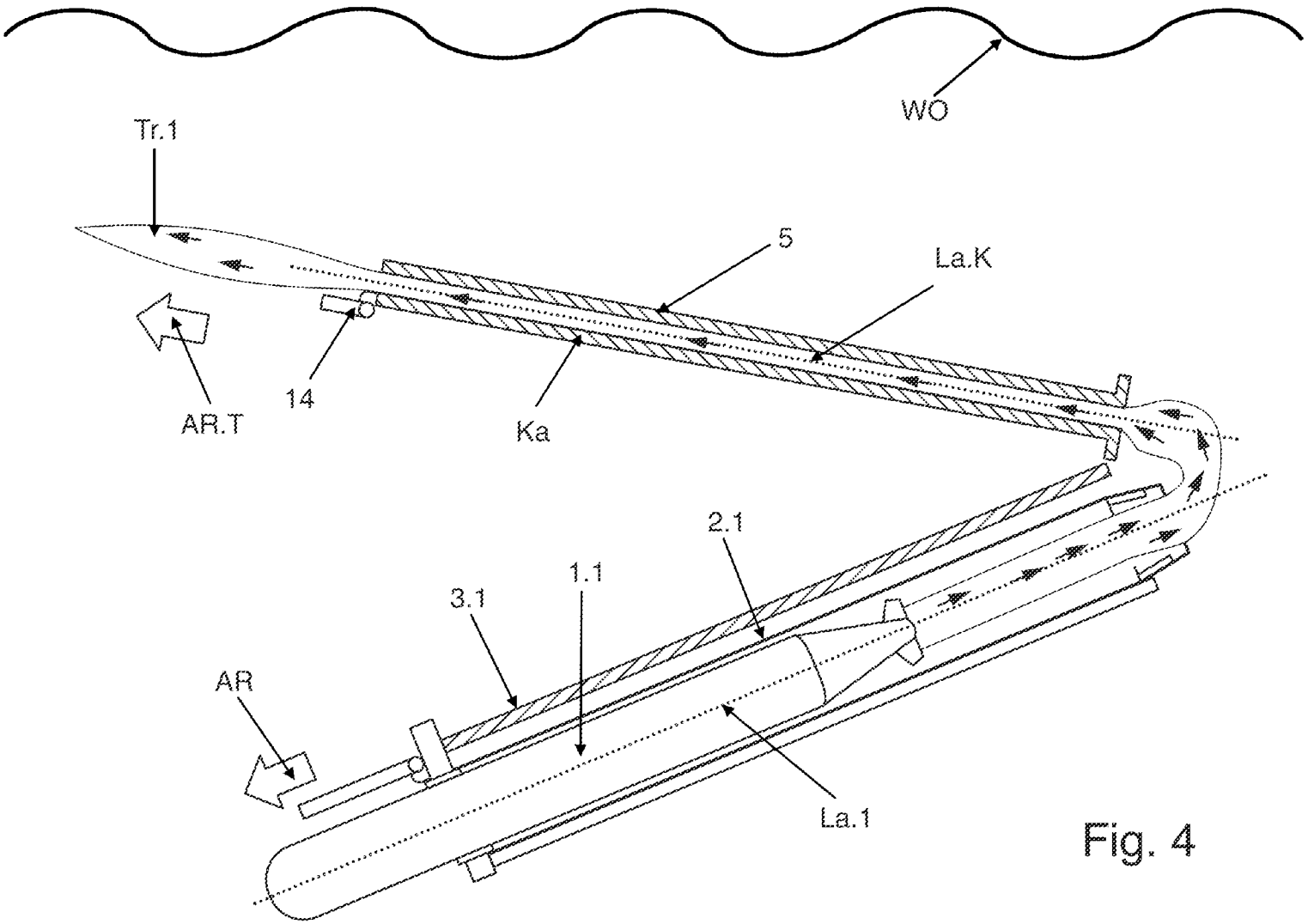
FIG. 4 is a side view of still another example launching device.

In FIG. 3 and FIG. 4, two alternative designs are shown. The second ramp 3.2, the second canister 2.2 and the second underwater rocket 1.2 are not shown in FIG. 3 and FIG. 4. FIG. 3 shows an alternative design in a plan view from above, FIG. 4 a further alternative design in a side view. The watercraft travels in a traveling direction FR (in FIG. 3 in the plane of the drawing and from the bottom upward, in FIG. 4 perpendicularly or obliquely in relation to the plane of the drawing). The longitudinal axis La.1 of the ramp 1.1 and the longitudinal axis La.K of the channel Ka likewise lie in the planes of the drawings of FIG. 3 and FIG. 4. The situations shown in FIG. 3 and FIG. 4 arise at least during the launching of the underwater running body 1.1. It is possible that a ramp actuating element that is not shown has previously pivoted the ramp 1.1 into the firing position shown.

In the example shown in FIG. 3, an angle of $\alpha=40°$ occurs between the longitudinal axis La.1 of the ramp 3.1 and the longitudinal axis La.K of the channel Ka. The longitudinal axis La.K of the channel Ka is perpendicular to the traveling direction FR, the longitudinal axis La.1 of the ramp 3.1 oblique to the traveling direction FR. The firing direction AR of the underwater rocket 1.1 is consequently directed obliquely forward. In the example of FIG. 3, the propellant deflection unit deflects the emitted propellant Tr.1 by $180°-\alpha=140°$. It goes without saying that other angles of deflection are also possible. Preferably, the angle of deflection lies between 90° and 180° (inclusive).

As can be seen in the side view of FIG. 4, in this example the firing direction AR of the underwater rocket 1.1 is directed obliquely downward and is perpendicular or oblique to the traveling direction FR of the watercraft. The longitudinal axis La.K of the channel Ka, and consequently the direction of emission AR.T of the propellant Tr.1, is directed obliquely upward. This prevents propellant Tr.1 from collecting in the channel Ka and bubbles escaping, and the watercraft therefore leaving a trail of bubbles behind it.

REFERENCE SIGNS

1.1 first underwater running body in the form of an underwater rocket, comprises the propulsion unit Tw.1, is accommodated in the first canister 2.1

1.2 second underwater running body in the form of an underwater rocket, is accommodated in the second canister 2.2

2.1 first canister, in which the first underwater rocket 1.1 is stored

2.2 second canister, in which the second underwater rocket 1.2 is stored

3.1 first ramp, in which the first canister 2.1 with the first underwater rocket 1.1 is stored and which guides the first underwater rocket 1.1 during launching

3.2 second ramp, in which the second canister 2.2 with the second underwater rocket 1.2 is stored and which guides the second underwater rocket 1.2 during launching

4 wall of the common chamber Km behind the two ramps 3.1 and 3.2

5 wall of a channel Ka, which leads to the outside from the chamber Km

6.1 muzzle flap or membrane in front of the first ramp 3.1, is opened or penetrated during the launching of the underwater rocket 1.1

6.2 muzzle flap or membrane in front of the second ramp 3.2, is opened or penetrated during the launching of the underwater rocket 1.2

7.1, 7.2 front membrane of the canister 2.1, 2.2, is penetrated during the launching of the underwater rocket 1.1, 1.2

8.1, 8.2 rear membrane of the canister 2.1, 2.2, adjoins the chamber Ka

9.1, 9.2 claws, which hold the underwater rocket 1.1 in the canister 2.1, are rotatable about the axis of rotation D.1 or D.2 and are connected in an articulated manner to the connection 11

10 pushrod, which is linearly movable and is connected by way of the articulated connection 11 to the claws 9.1, 9.2, is surrounded by the closing unit 12, penetrates the rear membrane 8.1

11 articulated connection between the claws 9.1, 9.2 and the pushrod 10, converts a linear movement of the pushrod 10 into a rotational movement of the two claws 9.1, 9.2

12 closing unit for the chamber Km.1 of the locking device, firmly connected to the pushrod 10, has a conical front part

13 closure plug at the rear end of the propulsion unit Tw.1 of the underwater rocket 1.1, is discharged from the canister 2.1 through the rear membrane 8.1 after the ignition of the propulsion unit Tw.1

14 flap, which closes the outlet A of the channel Ka, is opened by emitted propellant Tr.1 or by an actuating element

16 position sensor in the form of a contact switch, detects the event that the locking device is in the release position A outlet of the channel Ka, recessed in the vehicle hull Fh, closed by the flap 14

AR firing direction in which the underwater rocket 1.1 is fired out of the first ramp 3.1

AR.T outlet direction, in which the propellant Tr.1 is let out of the channel Ka through the outlet A D.1, D.2 axis of rotation about which the claws 9.1, 9.2 are rotatable Fh vehicle hull of the watercraft, in which the launching device with the ramps 2.1, 2.2 is recessed Ka channel, which leads to the outside from the chamber Km, is surrounded by the wall 5 and closed by the flap 14

Km common chamber behind the two ramps 3.1 and 3.2, receives emitted propellant Tr.1, is surrounded by the wall 4 and connected to the channel Ka Km.1 chamber of the locking device, surrounds the pushrod 10, is closed by the closing unit 12

La.1 longitudinal axis of the first ramp 3.1, coincides with the longitudinal axis of the first canister 2.1

La.2 longitudinal axis of the second ramp 3.2, coincides with the longitudinal axis of the second canister 2.2

La.K longitudinal axis of the channel Ka

Tr.1 propellant, which is emitted by the propulsion unit Tw.1 of the first underwater rocket 1.1 during launching Tw.1 propulsion unit of the first underwater rocket 1.1, emits the propellant Tr.1

WO surface of the water

What is claimed is:

1. A device for facilitating launching of a first underwater running body from a platform, with the first underwater running body including a first propulsion unit configured to emit a propellant, the device comprising:

a first ramp that extends along a first longitudinal ramp axis, wherein the first ramp is configured to enclose and hold the first underwater running body underwater and to guide the first underwater running body during launch based on an orientation of the first longitudinal ramp axis;

a first canister configured to be fitted into the first ramp and that stores the first underwater running body in a fluidtight manner, the first canister having a front membrane that cooperates to close the first canister with inert fluid around the first underwater running body; and a propellant deflection unit, wherein the device is configured to activate the first propulsion unit or permit activation of the first propulsion unit while the first underwater running body is enclosed and held in the first ramp underwater, wherein the first ramp is configured to direct the propellant emitted by the first propulsion unit to the propellant deflection unit, wherein the propellant deflection unit is configured to divert the propellant emitted by the first propulsion unit into an outlet direction, which is directed perpendicularly or obliquely away from the platform.

2. The device of claim 1 wherein the propellant deflection unit is positioned such that the outlet direction is parallel to the first longitudinal ramp axis and such that the propellant that is deflected leaves the propellant deflection unit at a distance from the first longitudinal ramp axis.

3. The device of claim 1 wherein the propellant deflection unit is positioned such that the outlet direction forms an acute angle with the first longitudinal ramp axis and such that the propellant deflection unit deflects the emitted propellant by an obtuse angle.

4. The device of claim 1, further comprising a second ramp configured to enclose, hold, and guide a second underwater running body underwater, and a chamber surrounded a wall behind both of the first and second ramps.

5. The device of claim 4 wherein each of the first ramp and the second ramp is configured to direct the propellant emitted by the first and second underwater running bodies into the propellant deflection unit.

6. The device of claim 1, further comprising a locking device that is transferable from a locking state into a release state, wherein the locking device in the locking state prevents movement of the first underwater running body in the first ramp relative to the first ramp, wherein the locking device in the release state allows the first underwater running body to leave the first ramp, wherein the device is configured to prevent activation of the first propulsion unit as long as the locking device is in the locking state.

7. The device of claim 6, further comprising a position sensor for detecting that the locking device is in the release state, wherein the device is configured to activate the first propulsion unit or permit activation of the first propulsion unit in response to the position sensor detecting that the locking device is in the release state.

8. The device of claim 1, wherein the device is configured such that water can penetrate into the first ramp.

9. The device of claim 8, further comprising a first ramp flap that in a closed state closes the first ramp off with respect to surrounding water, wherein the first ramp flap is openable to permit water to flow into the first ramp before the device activates the first propulsion unit of the first underwater running body.

10. The device of claim 1, further comprising a deflection unit flap that separates the propellant deflection unit from surrounding fluid, wherein the deflection unit flap is mounted such that emitted propellant can open or burst the deflection unit flap.

11. The device of claim 10 wherein the deflection unit flap is configured such that the emitted propellant opens or bursts the deflection unit flap only when a pressure exerted on the deflection unit flap exceeds a predetermined limit.

12. The device of claim 1, wherein the device is configured to be carried onboard a watercraft, wherein in a floating position of the watercraft the propellant deflection unit is positionable such that an entire path of movement of the emitted propellant in the propellant deflection unit is horizontal or ascending.

13. The device of claim 1, further comprising a ramp actuating element configured to pivot the first ramp.

14. A watercraft that comprises the device of claim 1.

15. The watercraft of claim 14, further comprising a weapon tube, wherein the device is fitted in the weapon tube.

16. The watercraft of claim 14 configured as an underwater vehicle with a pressure hull, wherein the pressure hull encloses an interior region in a pressure-tight manner, wherein the device is disposed outside the interior region.

17. The watercraft of claim 14 configured as a surface vessel, wherein in a floating position of the surface vessel the device is disposed below a surface of the water.

18. A method for launching a first underwater running body from a platform, wherein the first underwater running body comprises a propulsion unit, wherein a device with a first ramp that extends along a first longitudinal ramp axis is used to facilitate launching, the method comprising:

enclosing and holding the first underwater running body underwater, the enclosing comprising locating a first canister into the first ramp, the first canister storing the first underwater running body in a fluidtight manner, the first canister having a front membrane that cooperates to close the first canister with inert fluid around the first underwater running body;

activating the propulsion unit while the first underwater running body is enclosed in and held underwater by the first ramp;

emitting a propellant from the propulsion unit that has been activated;

guiding the first underwater running body with the first ramp during launch of the first underwater running body based on an orientation of the first longitudinal ramp axis;

directing the propellant emitted by the propulsion unit with the first ramp to a propellant deflection unit; and diverting the emitted propellant with the propellant deflection unit into an outlet direction, which is directed perpendicularly or obliquely away from the platform.

19. The method of claim 18 wherein the device comprises a locking device, wherein in a locking state the locking device prevents movement of the first underwater running body in the first ramp relative to the first ramp before the propulsion unit is activated, wherein the activation of the first propulsion unit is prevented as long as the locking device is in the locking state, wherein the activation of the propulsion unit comprises:

transferring the locking device into a release state; and the locking device in the release state allows the first underwater running body to leave the first ramp.

20. The method of claim 19 wherein the device comprises a position sensor for the locking device, wherein the position sensor is configured to detect transfer of the locking device into the release state, wherein the activation of the propulsion unit is prevented as long as the position sensor does not detect transfer of the locking device into the release state, wherein the activation of the propulsion unit is performed in response to the position sensor detecting that the locking device is in the release state.

21. The method of claim 18, further comprising pivoting the first ramp with a ramp actuating element from a traveling position into a firing position before the propulsion unit is activated.

* * * * *